United States Patent [19]

Sandy

[11] 4,118,863

[45] Oct. 10, 1978

[54] HAIR TRIMMING HEAD

[75] Inventor: Julius W. Sandy, Sycamore, Ill.

[73] Assignee: Wahl Clipper Corporation, Sterling, Ill.

[21] Appl. No.: 813,881

[22] Filed: Jul. 8, 1977

[51] Int. Cl.[2] ..... B26B 19/22

[52] U.S. Cl. ..... 30/195; 30/223

[58] Field of Search ..... 30/195, 196, 197, 222, 30/223, 90

[56] References Cited

U.S. PATENT DOCUMENTS

| | | | |
|---|---|---|---|
| 1,939,253 | 12/1933 | Dremel | 30/195 |
| 2,118,850 | 5/1938 | Marcel | 30/195 X |
| 3,999,295 | 12/1976 | Du Bois | 30/195 |

FOREIGN PATENT DOCUMENTS

| | | | |
|---|---|---|---|
| 70,103 | 10/1949 | Denmark | 30/195 |
| 5,865,500 | 10/1933 | Fed. Rep. of Germany | 30/223 |

*Primary Examiner*—Jimmy C. Peters

*Attorney, Agent, or Firm*—Vogel, Dithmar, Stotland, Stratman & Levy

[57] ABSTRACT

A hair trimming head for slow rate hair trimming and thinning having a stationary blade with cutting teeth and a movable blade with cutting teeth, the blades being mounted in effective cutting relation with the teeth of the movable blade projecting beyond the ends of the teeth on the stationary blade, whereby hair first engages the teeth of the movable blade and is agitated and fed in controlled manner between the movable teeth into cutting engagement with the teeth of the stationary blade.

The relative longitudinal positioning of the two blades is non-critical, it being necessary only to position the blades such that the effective cutting lengths of the teeth on the stationary blade lie within the limits of the effective cutting lengths of the teeth of the movable blade. The effective cutting length of the teeth of the stationary blade is of the order of about one or two times the diameter of human hair, thereby providing control over the amount of hair cut so overcutting and uneveness are avoided.

10 Claims, 7 Drawing Figures

HAIR TRIMMING HEAD

BACKGROUND OF THE INVENTION

This invention relates to an electric hair trimmer, and more particularly, to a trimming head for an electric hair trimmer.

A conventional electric hair clipper is effective for trimming and thinning hair in the hands of a professional barber or a skilled amateur, but is not satisfactory for self-use or use by an unskilled amateur. The reason, of course, is that a conventional clipper is capable of cutting far more hair at a time than is desired for trimming and thinning, operations desirably performed more frequently than professional haircuts.

An adjustable attachment for conventional hair clippers is shown in U.S. Pat. No. 3,651,570. The adjustable attachment is mountable on conventional clippers and includes a slotted bearing head adjacent the clipper blades. The head bears flat against the hair, and a certain amount of hair enters the slot and is fed to the blades. The attachment reduces the amount of hair fed to the blades, but the amount still may be far in excess of that required for trimming, thinning and touch-up purposes.

Another trimmer aimed at avoiding excessive cutting is a variation of a conventional clipper wherein the teeth of the movable blade are positioned longitudinally in critical relation with the forwardly projecting teeth of the stationary blade such that there is extremely small overlap of the two sets of teeth. This approach, while in the desired direction, involves costly manufacture and provides less than desirable trimming and thinning action. The hair cutting action takes place only after feeding through the teeth of the stationary blade and is somewhat uneven due to the fact that hair tends to jam between the stationary teeth and reaches the movable teeth in grouped manner.

SUMMARY OF THE INVENTION

The present hair trimming head comprises a support adapted to be mounted on a housing containing a drive motor, vibratory or rotary, a stationary blade mounted rigidly on the support having an exposed forward end containing cutting teeth, a movable blade having an exposed forward edge containing cutting teeth several times the length of the cutting teeth of the stationary blade, means mounting the movable blade for reciprocating lateral movement with respect to the support, the stationary and movable blades being mounted in effective cutting relation with the teeth of the movable blade projecting beyond the ends of the teeth of the stationary blade, whereby hair first engages the teeth of the movable blade and is agitated and fed in controlled manner therebetween into engagement with the teeth of the stationary blade for cutting at a rate such that overcutting is avoided.

In more detailed aspect, the effective cutting length of the cutting teeth of the stationary blade is of the order of about one or two times the diameter of human hair, thereby insuring against overcutting and unevenness.

Economy of manufacture is achieved by reason of the non-critical longitudinal relationship between the two blades. In mounting the blades, it is necessary only that the effective cutting lengths of the teeth of the stationary blade be positioned longitudinally anywhere within the effective cutting lengths of the teeth of the movable blade. The rate of cutting is determined primarily by the effective cutting length of the stationary teeth.

Other objects, advantages, and details of the invention will become apparent as the description proceeds, reference being had to the accompanying drawing wherein a preferred embodiment of the invention is shown. It is to be understood that the description and drawing are exemplary only and that the scope of the invention is to be measured by the appended claims.

DESCRIPTION OF THE PREFERRED EMBODIMENT

Figure 1:
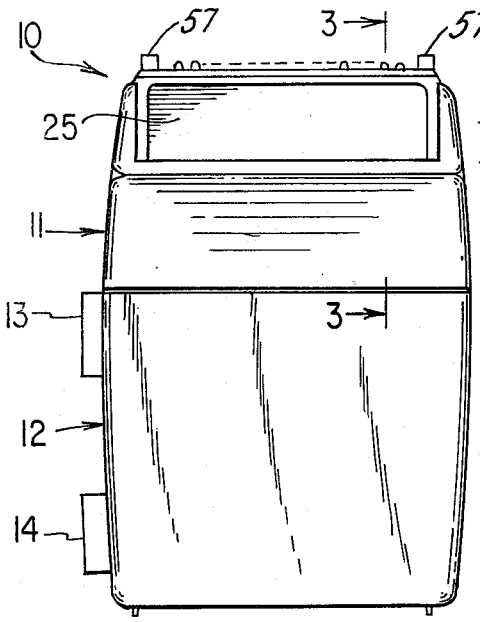
FIG. 1 is an elevational view of a hair trimmer having a trimming head embodying the invention.
Figure 2:
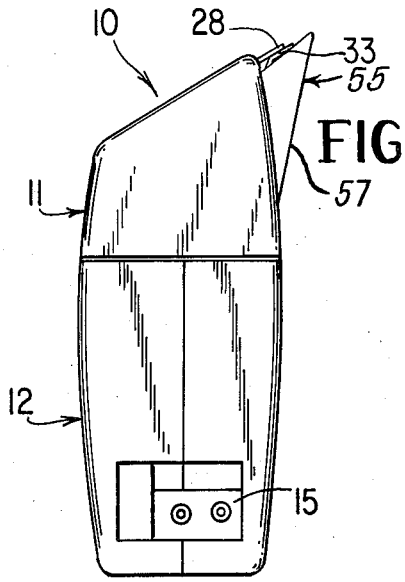
FIG. 2 is a side elevational view of the trimmer shown in FIG. 1.

Referring to the drawing, and particularly to FIGS. 1 and 2, a hair trimmer generally designated 10 includes a hair trimming head 11, the subject of the invention, and a casing 12 containing a conventional drive motor (not shown). The numeral 13 designates a depressible manual member serving to release head 11 from casing 12, while the numeral 14 designates a manual actuator for an electric switch, assuming an electric motor is contained within casing 12. The numeral 15 in FIG. 2 designates connection means for a power cord (not shown), again assuming an electric motor within casing 12.

Trimming head 11, the subject of the invention, now will be described with reference to FIGS. 3 - 7.

Figure 3:
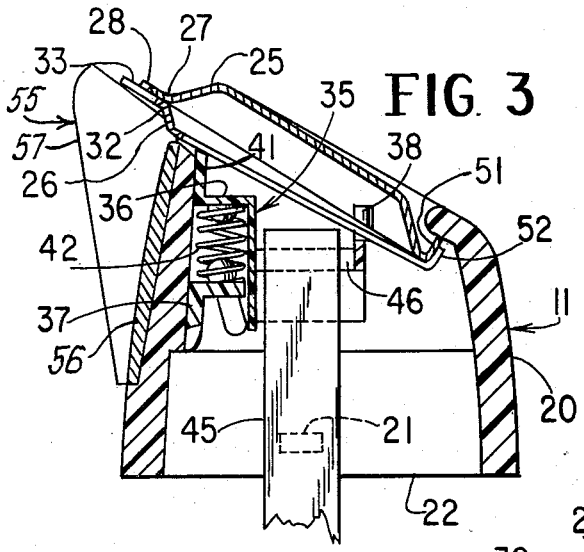
FIG. 3 is an enlarged sectional view of the trimming head taken on line 3—3 of FIG. 1.

Referring to FIG. 3, trimming head 11 includes a support 20 of suitable material such as molded plastic. Support 20 is adapted to have a readily detachable relationship with casing 12, and the numeral 21 designates a lug on the interior of support end wall 22 which cooperates with a complementary lug on the adjacent end wall of casing 12. The counterpart lug on the opposite end wall of casing 12 is a spring biased member (not shown) which cooperates with the counterpart of lug 21 on the opposite end wall of support 20, as is conventional with detachable heads on dry shavers. The aforesaid spring biased member is actuated by manual member 13.

The hair trimming members of trimming head 11 are stationary blade 25 and movable blade 26. The two blades 25 and 26 are shown in assembled relation in cross-section in FIG. 3, in plan view in FIG. 4, and in side view in FIG. 5. Both blades are made of suitable metallic material, but one feature of the invention is that the blades may be formed economically of stamped sheet metal. Alternatively, they may be made of thick blade steel such as commonly used in hair clippers.

Stationary blade 25 is mounted rigidly on support 20, and has an exposed forward edge 27 containing cutting teeth 28. A fragmentary enlarged view of the exposed forward edge 27 and teeth 28 of stationary blade 25 is shown in FIG. 7.

Figure 7:
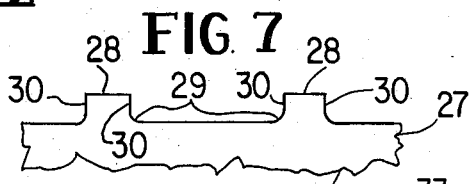
FIG. 7 is a fragmentary enlarged plan view of the teeth of the stationary blade, the scale in FIG. 7 being about 5 times that of FIG. 4.

Referring to a cutting tooth 28 in FIG. 7, radii 29 are present where the foot of a tooth 28 ioins the forward edge 27 of stationary blade 25. The arcuate radii portions of teeth 28 are not effective in cutting hair, meaning that the effective cutting length of a tooth 28 is that represented by the straight sides 30 of the tooth. This effective cutting length is extremely small and is of the order of about one or two times the diameter of human hair. As will be seen, the short effective cutting lengths of teeth 28 of stationary blade 25 cooperate with other features of the invention to limit the amount of cutting so overcutting and unevenness are avoided. In one commercial embodiment of the invention, straight sides 30 of teeth 28 have a length falling between 0.0045 and 0.0075 inches. Human hair has an average diameter of about 0.004 inches.

Figure 6:
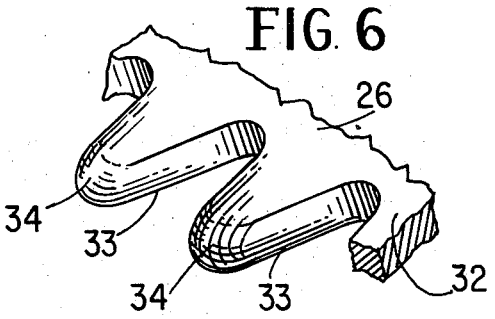
FIG. 6 is a fragmentary enlarged perspective view of the teeth of the movable blade.

Movable blade 26 has an exposed forward edge 32 containing cutting teeth 33 several times the length of cutting teeth 28 of stationary blade 25. A fragmentary enlarged perspective view of forward edge 32 and cutting teeth 33 of movable blade 26 is shown in FIG. 6. The free ends of teeth 33 are rounded as shown at 34 to avoid scratching or cutting skin.

Suitable means, generally designated 35 (FIG. 3), are provided for mounting movable blade 26 for reciprocating lateral movement with respect to support 20. As shown, mounting means 35 takes the form of plastic parts 36 and 37. Part 36 has a pair of integral bosses 38, one of which is shown in FIG. 3, which are received within apertures 39 and 40 (FIG. 4) in blade 26. Mounting part 36 also has an edge 41 which bears on blade 26 near the forward blade edge. Mounting part 37 is removably fixed within support 20, and a pair of springs 42, one of which is shown in FIG. 3, extend between the two parts 36 and 37 of the mounting means 35. Springs 42, of course, apply cutting tension between the teeth 28 and 33 of the respective stationary and movable blades 25 and 26, as is conventional in hair clippers and dry shavers.

Still referring to FIG. 3, the numeral 45 designates a reciprocating member extending from the motor contained within casing 12. As shown, member 45 is received within an opening 46 in part 36 of mounting means 35 for movable blade 26. Member 45, of course, reciprocates laterally of head 11, and drives movable blade 26 in cutting relation with stationary blade 25. Illustrated mounting means 35 for movable blade 26 and the relationship thereof with reciprocating member 45 are exemplary, and other arrangements between member 45 and movable blade 26 are possible. Another version contemplates a spring means (for cutting tension) mounted directly on the end of member 45, the spring means directly engaging and mounting the movable blade 26. Alternatively, member 45 may directly engage movable blade 26 in driving relationship, and spaced springs such as springs 42 extend between support 20 and blade 26 to provide cutting tension between the blades.

Figure 4:
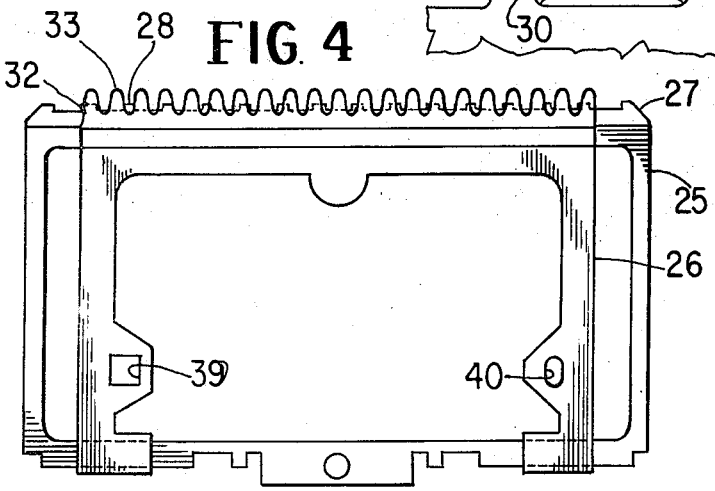
FIG. 4 is a plan view of the superposed movable and stationary blades embodied in the trimming head of the invention.
Figure 5:
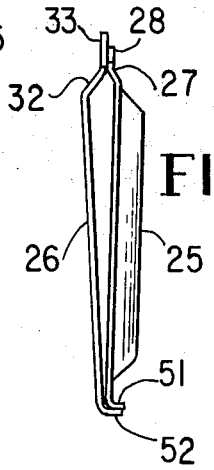
FIG. 5 is a side view of the superposed clipper blades shown in FIG. 4.

As previously mentioned, the two blades 25 and 26 are mounted longitudinally of head 11 in non-critical position. It is important only that the teeth 28 of stationary blade 25 be located longitudinally anywhere within the effective cutting length of teeth 33 of movable blade 26. A suitable relative positioning of the two blades is shown in FIGS. 3, 4 and 5. This non-critical longitudinal positioning of the blades permits desirable manufacturing economy without loss of desired cutting action at controlled rate.

Referring to FIGS. 3 and 5, stationary blade 25 at its rear edge has a pair of transversely spaced flanges 51 (only one of which is shown in the figures), and movable blade 26 likewise has a pair of spaced flanges 52 (only one of which is shown in the figures). Flanges 52 overlie flanges 51, and provide bearing surfaces at the rear edges of the two blades, as well as provide proper relative longitudinal positioning of the two blades.

Within limits the number of teeth on the respective blades is not critical. It has been found that desirable cutting occurs when the number of teeth on the movable and stationary blades have a ratio of about 3:2. In one commercial embodiment of the invention, the movable blade has about 21 teeth and the stationary blade has about 14 teeth. The teeth on the respective blades desirably are spaced uniformly.

The reciprocation frequency of the movable blade also is non-critical within limits. A satisfactory frequency is about 120 cycles per second, which, of course, is the frequency of an armature of a vibratory motor energized from a commercial power source in the U.S.

Completing the description, head 11 of trimmer 10 desirably has a guard, generally designated 55 in FIGS. 2 and 3. Guard 55 includes a plate 56, shown in cross-section in FIG. 3, extending transversely of the adjacent wall of support 20 on which guard 55 is mounted. At each end of plate 56 is an integral generally triangular-shaped flange 57, one of the flanges 57 being shown in both FIGS. 2 and 3. The upper ends of both flanges are shown in FIG. 1. Flanges 57 may engage the scalp during certain trimming operations as an aid in controlling the trimming action, and they also prevent the end teeth 33 of movable blade 26 from coming in contact with the skin of the user. Further, flanges 57 protect the blade teeth from possible damage when trimmer 10 is placed at rest on a flat surface.

From the above description it is thought that the construction and advantages of this invention will be readily apparent to those skilled in the art. Various changes in detail may be made without departing from the spirit or losing the advantages of the invention.

What is claimed is:

1. A hair trimming head, comprising:

a support;

a stationary blade mounted rigidly on said support, said stationary blade having an exposed forward edge containing cutting teeth, said cutting teeth having an effective cutting length of the order of one or two times the diameter of human hair;

a movable blade having an exposed forward edge containing cutting teeth several times the length of the cutting teeth of said stationary blade;

means mounting said movable blade for reciprocating lateral movement at a frequency significantly greater than manual frequency with respect to said support;

said stationary and movable blades being mounted in effective cutting relation with the teeth of said movable blade projecting beyond the ends of the teeth of said stationary blade, whereby hair first engages the teeth of said movable blade and is agitated and fed in controlled manner between said teeth into engagement with the teeth of said stationary blade for cutting at a rate such that overcutting is avoided.

2. The trimming head of claim 1 wherein said stationary blade is mounted longitudinally such that the teeth thereon are positioned anywhere within the effective cutting length of the teeth on said movable blade, whereby cutting rate is determined by the length of the teeth on said stationary blade, and the longitudinal relation between said blades is non-critical, permitting manufacturing economy.

3. The trimming head of claim 1 with the addition of spring means extending between said support and said movable blade mounting means for providing cutting tension between the teeth of the respective blades.

4. The trimming head of claim 1 wherein the number of teeth on said movable and stationary blades have a ratio of about 3:2.

5. The trimming head of claim 4 wherein the teeth on the respective blades are spaced uniformly.

6. The trimming head of claim 1 wherein said stationary blade has about 14 teeth and said movable blade has about 21 teeth.

7. The trimming head of claim 1 wherein the free ends of the teeth on said movable blade are rounded and smooth so as to avoid damage to skin.

8. The trimming head of claim 1 wherein said stationary and movable blades are economical metal stampings.

9. The trimming head of claim 1 wherein said stationary blade has a linear rear edge providing guide surfaces and said movable blade has guided surfaces engaging said guide surfaces, whereby said blades properly and economically are positioned longitudinally with respect to each other and said movable blade is guided properly for reciprocating lateral movement.

10. The trimming head of claim 9 wherein said blades are formed of sheet metal and said guide and guided surfaces are cooperating flanges on the rear edges of the respective blades.

* * * * *